US009677729B2

(12) United States Patent
Fang

(10) Patent No.: US 9,677,729 B2
(45) Date of Patent: Jun. 13, 2017

(54) FLUTTERING-FLAME SIMULATION DEVICE

(71) Applicant: Jian Fang, Guangdong (CN)
(72) Inventor: Jian Fang, Guangdong (CN)

( * ) Notice: Subject to any disclaimer, the term of this patent is extended or adjusted under 35 U.S.C. 154(b) by 222 days.

(21) Appl. No.: 14/708,285

(22) Filed: May 10, 2015

(65) Prior Publication Data

US 2016/0298816 A1 Oct. 13, 2016

(30) Foreign Application Priority Data

Apr. 13, 2015 (CN) ..... 2015 2 0221625

(51) Int. Cl.

| | |
|---|---|
| ***F21S 10/04*** | (2006.01) |
| ***F21K 2/00*** | (2006.01) |
| *F21V 35/00* | (2006.01) |
| *F21S 6/00* | (2006.01) |
| *F21Y 115/10* | (2016.01) |

(52) U.S. Cl.
CPC ..... *F21S 10/046* (2013.01); *F21K 2/00* (2013.01); *F21S 10/04* (2013.01); *F21S 6/001* (2013.01); *F21V 35/00* (2013.01); *F21V 35/003* (2013.01); *F21Y 2115/10* (2016.08)

(58) Field of Classification Search
CPC ..... F21S 10/04; F21S 10/046; F21S 6/001; F21V 35/00; F21V 35/003
USPC ..... 362/161, 392, 569, 810
See application file for complete search history.

(56) References Cited

U.S. PATENT DOCUMENTS 9,322,524 B1 * 4/2016 Lin ..... F21S 10/046
2010/0214765 A1 * 8/2010 Yu ..... A47G 19/2227 362/101
2014/0211458 A1 * 7/2014 Lai ..... F21V 35/00 362/161
2014/0218903 A1 * 8/2014 Sheng ..... F21S 10/04 362/190
2015/0338042 A1 * 11/2015 Patton ..... F21V 33/0052 348/742
2015/0362141 A1 * 12/2015 Chen ..... F21S 10/046 362/183
2015/0369431 A1 * 12/2015 Li ..... F21S 6/001 362/249.1

(Continued)

FOREIGN PATENT DOCUMENTS

CN 204042739 * 8/2014 ..... F21S 10/04

OTHER PUBLICATIONS

English Abstract of CN 204042739 from Espacenet.*

*Primary Examiner* — Renee Chavez
*Assistant Examiner* — Zheng Song

(57) ABSTRACT

A fluttering-flame simulation device having a shell, a flame body, an external force generating device mounted in the shell, and at least one light-emitting device; the flame body is provided with a flame sheet imitating the shape of flame; the flame sheet extends out of the shell through a through hole in the shell; light of the light-emitting device is projected upon the flame sheet; a lower portion of the flame body is provided with a hollow cone; the shell is provided inside with a support member, which extends into the cone at the lower portion of the flame body to support the flame body, making the flame body still able to return to the initial vertical state after shaking around a support point under the force from the external force generating device, thus forming a tumbler-type flame body.

14 Claims, 15 Drawing Sheets

(56) References Cited

U.S. PATENT DOCUMENTS

| | | | | |
|---|---|---|---|---|
| 2016/0138770 | A1* | 5/2016 | Patton | F21S 6/001 362/284 |
| 2016/0146413 | A1* | 5/2016 | Wu | F21S 6/001 362/277 |
| 2016/0146414 | A1* | 5/2016 | Dong | F21S 10/046 362/232 |
| 2016/0153630 | A1* | 6/2016 | Dong | F21S 10/046 362/284 |
| 2016/0290579 | A1* | 10/2016 | Au | F21S 10/046 |

* cited by examiner

FLUTTERING-FLAME SIMULATION DEVICE

BACKGROUND OF THE INVENTION

The present invention relates to the field of light-emitting device technology, specifically to a fluttering-flame simulation device.

With the continuous development of society, people's quantity of life has been improved continuously. In pursuit of excellent quality of life, the requirements for indoor environment are more and more critical. People often light candles, so as to create a comfortable and elegant living atmosphere. However, due to human negligence, a lit traditional candle may result in a fire by igniting inflammables, having some security risks and also causing environmental pollution. Besides, the candle is hot in the burning process and cannot be touched directly, otherwise it is easy to get burnt by the wax liquid or flame. Moreover, the service life of the candle is very short, and cannot last long in burning. Therefore, there have emerged electronic flash candles, electronic candles, simulation candles and other electronic light-emitting devices.

For example, in a Chinese patent No. 201010211402.8 entitled "Electronic Light-Emitting Device Imitating Real Fire and Method Thereof for Imitating Real Fire", the electronic light-emitting device comprises a shell, a flame sheet, a light-emitting element and a swing mechanism, the flame sheet being mounted at the top of the shell by a wire-shaped rod going through a through hole in the center of the flame sheet, the swing mechanism being able to exert a force on the flame sheet to make it shake or swing. The light-emitting portion of such an electronic light-emitting device tries to imitate the light-emitting form of the candle, simulating its light flashing, flickering and other features. However, the flame sheet of this device has poor fidelity and fluttering sensation, and is hard to cooperate with the projected light after shaking, much different from the real flame of the real lit candle, with the visual experience still unreal.

BRIEF SUMMARY OF THE INVENTION

A purpose of the present invention is to overcome the above defects in the prior art, and provide a fluttering-flame simulation device.

In order to achieve the above purpose, the present invention provides the following technical solution: A fluttering-flame simulation device is provided, comprising a shell, a flame body, and an external force generating device mounted inside the shell, as well as at least one light emitting device; with the flame body provided at the upper portion with a flame sheet imitating the shape of flame and having certain curvature, the flame sheet extends out of the shell through a through hole in the shell, and light of the light emitting device is projected upon the flame sheet; at the lower portion of the flame body is a hollow cone; the shell is provided inside with a support member, which extends into the cone at the lower portion of the flame body to support the flame body, making the flame body still able to return to the initial vertical state after shaking around a support point under the force from the external force generating device, thus forming a tumbler-type flame body.

Preferably, the support member is composed of a support head with balls and a support pillar, with the support head fixed at the top of the support pillar; alternatively, the support member is composed of a support head with balls, a support pillar, and a support plate mounted in the shell, with the support head fixed at the top of the support pillar that is fixed on the support plate.

Preferably, the cone at the lower portion of the flame body is provided outside with two symmetrical limit bars, which are connected at the lower end with a mounting plate; the cone at the lower portion of the flame body is spaced from the mounting plate, with the support plate located between the cone at the lower portion of the flame body and the mounting plate; when the flame body shakes, the limit bar can touch the support plate so as to limit the amplitude of the flame body shaking around.

Preferably, the cone at the lower portion of the flame body is provided outside with at least one limit hole or limit slot; a limit needle, fixed on the support member, has its end in the limit hole or limit slot, so as to limit the amplitude of the flame body shaking around.

Preferably, the flame sheet is composed of a photosensitive sheet made of three different photosensitive materials.

Preferably, the flame sheet is provided inside with a spherical or liquid photosensitive object.

Preferably, the shell comprises an inner shell and a candle-shaped outer shell, with the outer shell sleeved outside the inner shell.

Preferably, the shell is provided inside with a circuit board and a power supply unit used for controlling the external force generating device and the light emitting device, with the circuit board electrically connected with the external force generating device, the light emitting device and the power supply unit.

Preferably, the external force generating device comprises a motor, a gearbox, a turntable, a first magnet and a second magnet, the motor being connected to the gearbox in transmission, the turntable being fixedly connected to an output shaft of the gearbox, the first magnet being mounted on the turntable, the second magnet being mounted on the bottom of the cone at the lower portion of the flame body; when the motor drives the turntable to rotate through the gearbox, the first magnet and the second magnet can make the flame body shake through magnetic attraction or repulsion.

Preferably, the external force generating device comprises a motor, a gearbox and a Y-shaped rotating touch arm, the motor being connected to the gearbox in transmission, the rotating touch arm being fixedly connected to the output shaft of the gearbox, a collision block being provided on the mounting plate on the bottom of the cone at the lower portion of the flame body; when the motor drives the rotating touch arm to rotate through the gearbox, the rotating touch arm can collide with the collision block, thus making the flame body shake.

Preferably, the external force generating device comprises a motor, a gearbox and a fan wheel, the motor being connected to the gearbox in transmission, the fan wheel being fixedly connected to the output shaft of the gearbox, the support member being mounted on the fan wheel; when the motor drives the fan wheel to rotate through the gearbox, the wind generated by the fan wheel makes the flame body shake.

Preferably, the external force generating device comprises an electromagnetic coil and a third magnet, with the third magnet mounted on the bottom of the cone at the lower portion of the flame body; the electromagnetic coil generates a magnetic force from time to time that, together with the third magnet, makes the flame body shake through the magnetic attraction or repulsion.

Preferably, the external force generating device comprises a water pump, which is mounted in a sealed cavity formed in the shell, with the water pump making the liquid in the sealed cavity impact the flame body through a water pipe to cause the flame body to shake; the liquid is preferably water or a liquid having a pleasant smell.

Preferably, the circuit board is provided with a lamp string connection port, which is electrically connected to a lamp string wrapped outside the shell, thus forming three-dimensional light combination.

Compared with the prior art, the present invention has the following beneficial effects:

At the upper portion of the flame body of the present invention is a flame sheet imitating the shape of flame and having certain curvature, and at the lower portion of the flame body is a hollow cone; the flame body, under the force from the external force generating device, can shake around a support point that may be the support member, and can still return to the initial vertical state after shaking, thus forming a tumbler-type flame body. When light of the light emitting device is projected upon the flame sheet, the projection of the light on the flame sheet swings therewith, and the flame body can be in good cooperation with the light, which greatly improve fidelity and fluttering sensation of the product, and enhance the visual experience for the product, making the product simulate real fire more realistically and thus more interesting and entertaining.

The fluttering-flame simulation device of the present invention will be further described below with reference to drawings and examples.

DETAILED DESCRIPTION OF THE INVENTION

What are described in the following are the most preferred examples of the fluttering-flame simulation device of the present invention, but will not limit the scope of protection of the present invention.

Example 1

Figure 1:
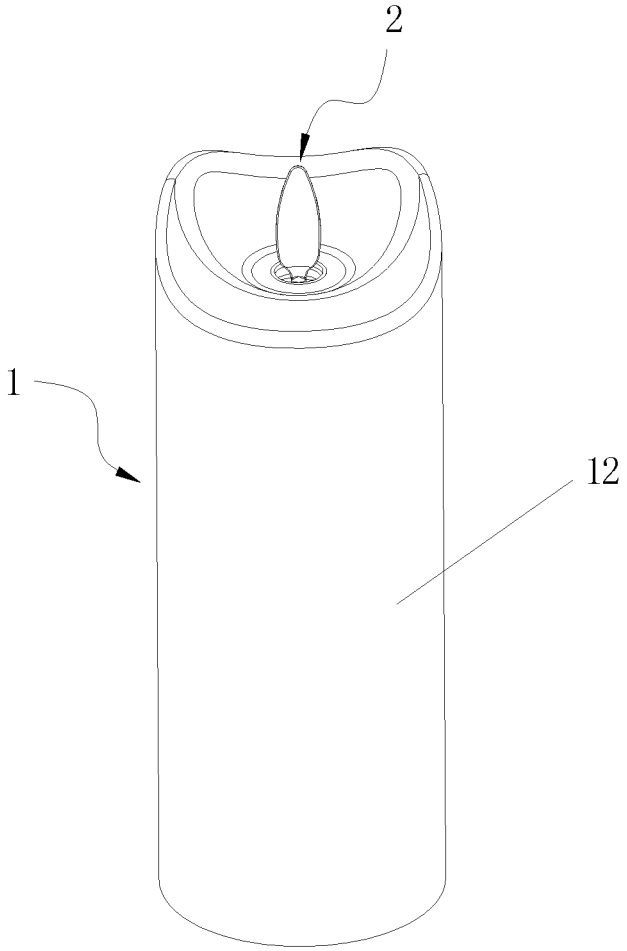
FIG. 1 is a schematic diagram of the structure of the fluttering-flame simulation device described in Example 1 of the present invention.
Figure 2:
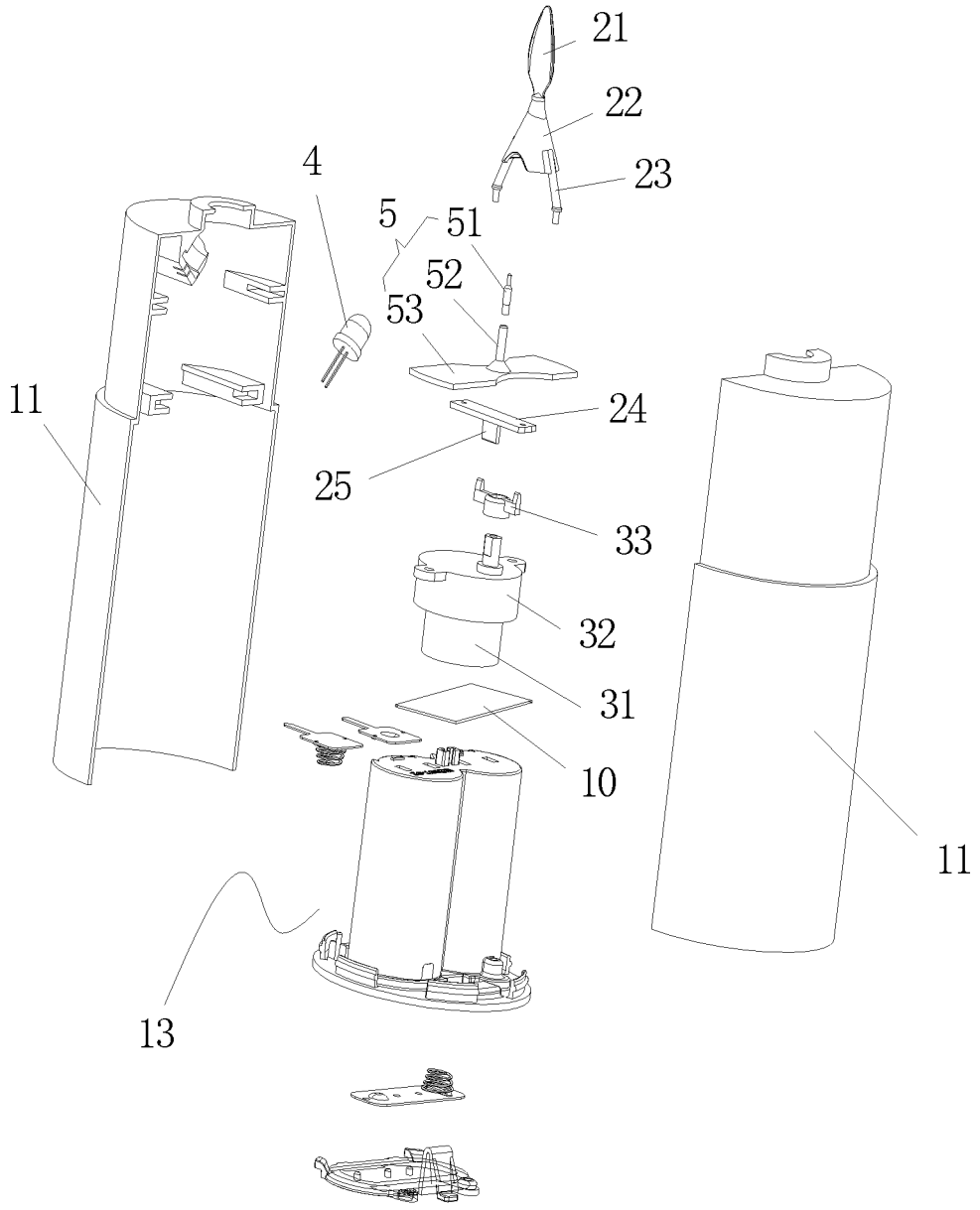
FIG. 2 is an exploded diagram of the fluttering-flame simulation device described in Example 1 of the present invention after the outer shell is hidden.
Figure 3:
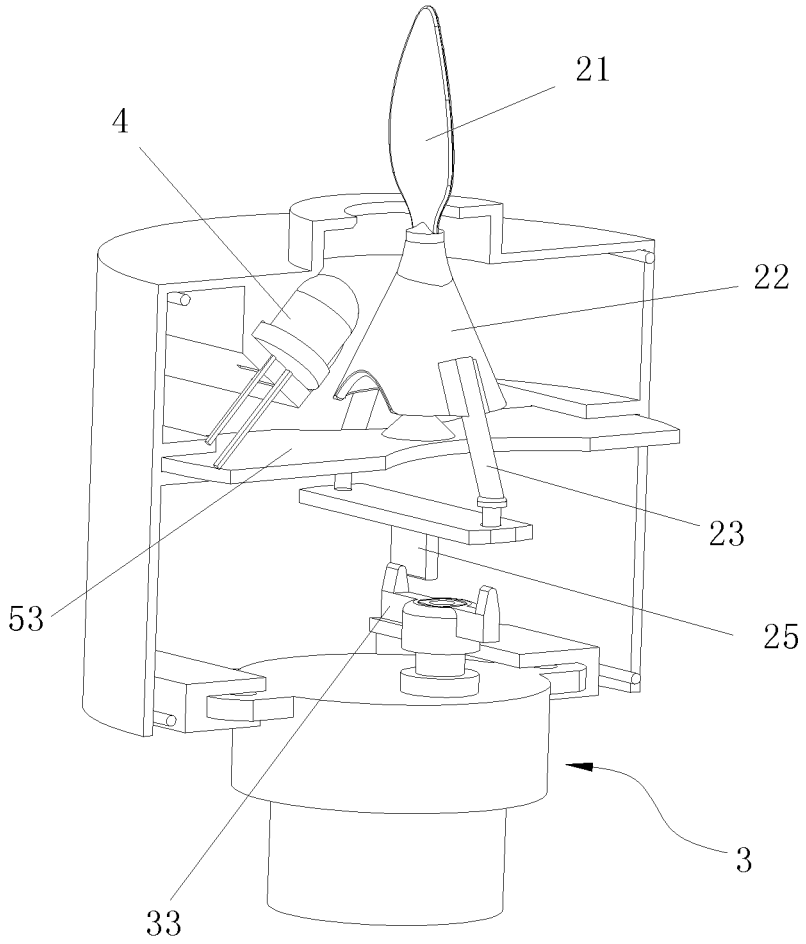
FIG. 3 is a schematic diagram of the partial structure of the fluttering-flame simulation device described in Example 1 of the present invention.

As shown in FIGS. 1, 2 and 3, a fluttering-flame simulation device is provided, comprising a shell 1, a flame body 2, an external force generating device 3, and one or more light-emitting devices 4 (such as LED lamps), wherein the shell 1 is provided inside with a support member 5 for supporting the flame body 2, the external force generating device 3 and the light-emitting device 4 are mounted in the shell 1, respectively, and the external force generating device 3 is located below the flame body 2 for exerting a force on this flame body 2 after being powered on to make this flame body 2 shake.

In the example as shown in FIGS. 1 and 2, the shell 1 comprises an inner shell 11 and a candle-shaped outer shell 12, wherein the inner shell 11 can be formed by two symmetrical plastic shells, the outer shell 12 is sleeved outside the inner shell 11, with the inner shell 11 provided at the top with a through hole for allowing the flame body 2 to extend out and the light of the light-emitting device 4 to be projected onto the flame body 2.

As shown in FIGS. 2 and 3, the support member 5 is composed of a support head 51 with balls, a support pillar 52, and a support plate 53 mounted in the shell 1, the support head 51 being fixed at the top of the support pillar 52 that is fixed on the support plate 53; wherein the support head 51 with balls is advantageous to shake of the flame body 2.

Figure 4:
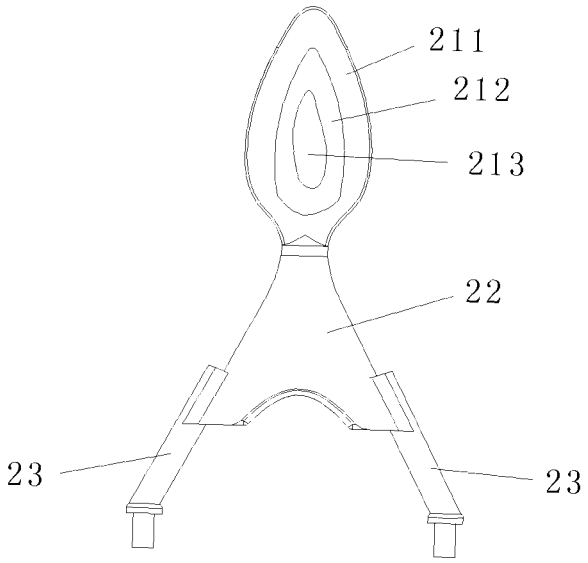
FIG. 4 is a schematic diagram of the structure of the flame body described in Example 1 of the present invention.

As shown in FIGS. 3 and 4, the flame body 2 is set to be a tumbler-type flame body; the flame body 2 is provided at the upper portion with a flame sheet 21 imitating the shape of flame and having certain curvature, with the flame sheet 21 extending out of the shell 1 through a through hole in the shell 1; at the lower portion of the flame body 2 is a hollow cone 22 having an opening at the bottom. While in assembly, the support head 51 of the support member 5 extends into the cone 22 at the lower portion of the flame body 2 and abuts against the flame body 2 top to top, so as to support the flame body 2; the flame body 2, under the force from the external force generating device 3, can shake around a support point that may be the support head 51 of the support member 5, and can still return to the initial vertical state (i.e., the balanced state) after shaking. While in operation, when the light of the light emitting device 4 is projected upon the flame sheet, the projection of the light on the flame sheet swings therewith, and the flame body can be in good cooperation with the light, which greatly improve fidelity and fluttering sensation of the product, and enhance the visual experience for the product.

As a preferred embodiment, the flame sheet 21 at the upper portion of the flame body 21 can be composed of a photosensitive sheet made of three different kinds of photosensitive materials, so as to enhance the visual effect, wherein this photosensitive material may be metal, glass or other different photosensitive material. In addition, the flame sheet 21 can be also provided inside with a spherical or liquid photosensitive object, such that when the flame body 2 shakes, the photosensitive object will be also displaced immediately, which can enhance the 3D visual sensation of the flame body 2 in cooperation with the light.

As shown in FIG. 3, in order to limit the amplitude of the flame body 2 shaking around, the cone 22 at the lower portion of the flame body 2 is provided outside with two symmetrical limit bars 23, which are connected at the lower end with a mounting plate 24; the cone 22 at the lower portion of the flame body 2 is spaced from the mounting plate 24, with the support plate 53 located between the cone 22 at the lower portion of the flame body 2 and the mounting plate 24; when the flame body 2 shakes at a large amplitude, the limit bar 23 can abut against the support plate 53 at the edge top to top.

Figure 14:
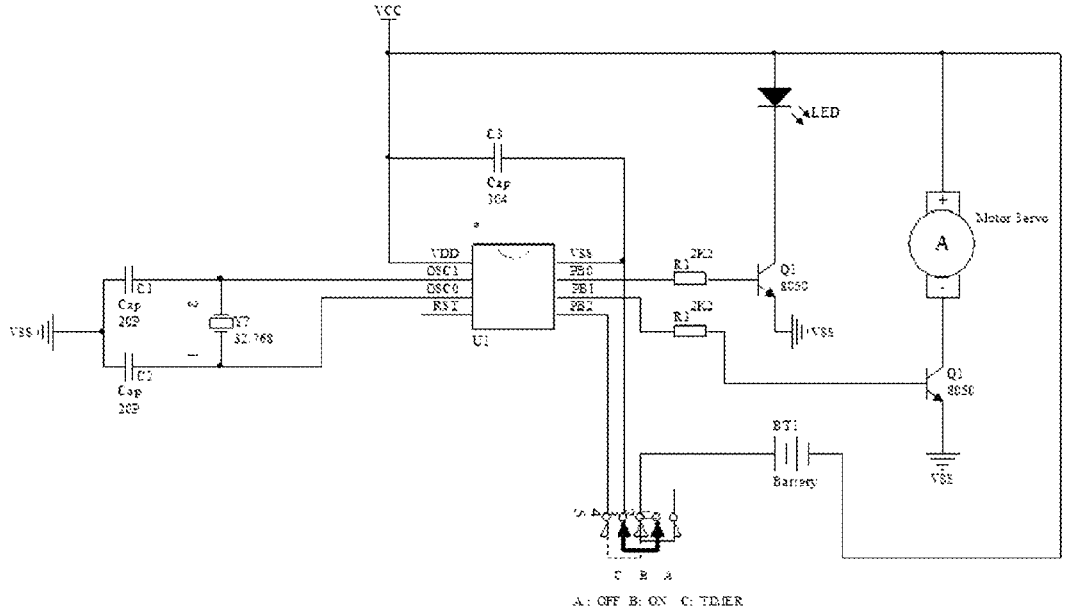
FIG. 14 is a diagram of the motor-driven circuit on the circuit board of the present invention.

As shown in FIG. 2, the shell 1 is provided inside with a circuit board 10 and a power supply unit 13 used for controlling the external force generating device 3 and the light emitting device 4, with the circuit board 10 electrically connected with the external force generating device 3, the light emitting device 4 and the power supply unit 13. Wherein this power supply unit 13 may be a battery container or an external power supply. As shown in FIG. 14, the circuit board 10 is provided with a motor-driven circuit.

Specifically, the external force generating device 3 comprises a motor 31, a gearbox 32 and a Y-shaped rotating touch arm 33, the motor 31 being connected to the gearbox 32 in transmission, the rotating touch arm 33 being fixedly connected to the output shaft of the gearbox 32, a collision block 25 being provided on the mounting plate 24 on the bottom of the cone 22 at the lower portion of the flame body 2; when the motor 31 drives the rotating touch arm 33 to rotate through the gearbox 32, the rotating touch arm 33 can collide with the collision block 25, thus making the flame body 2 shake.

In addition, in order to create a better atmosphere, the circuit board 10 can be additionally provided with a lamp string connection port, which is electrically connected to a lamp string wrapped outside the shell 1, thus forming three-dimensional light combination.

Example 2

Figure 5:
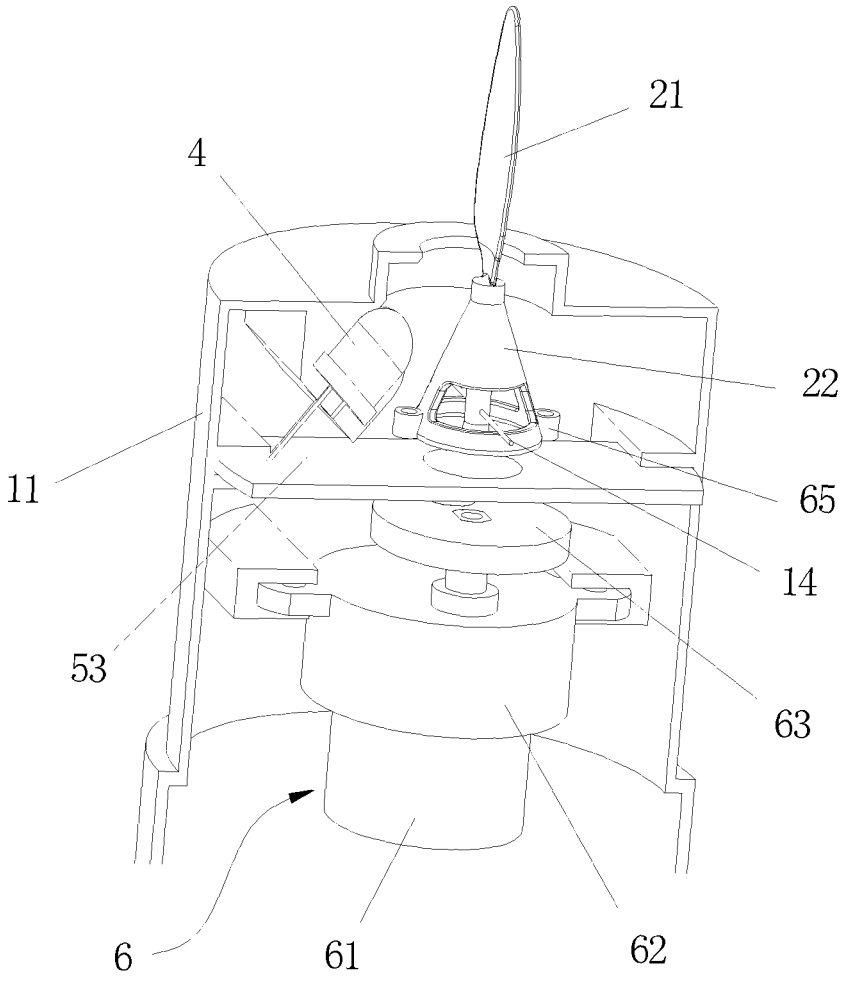
FIG. 5 is a schematic diagram of the partial structure of the fluttering-flame simulation device described in Example 2 of the present invention.
Figure 6:
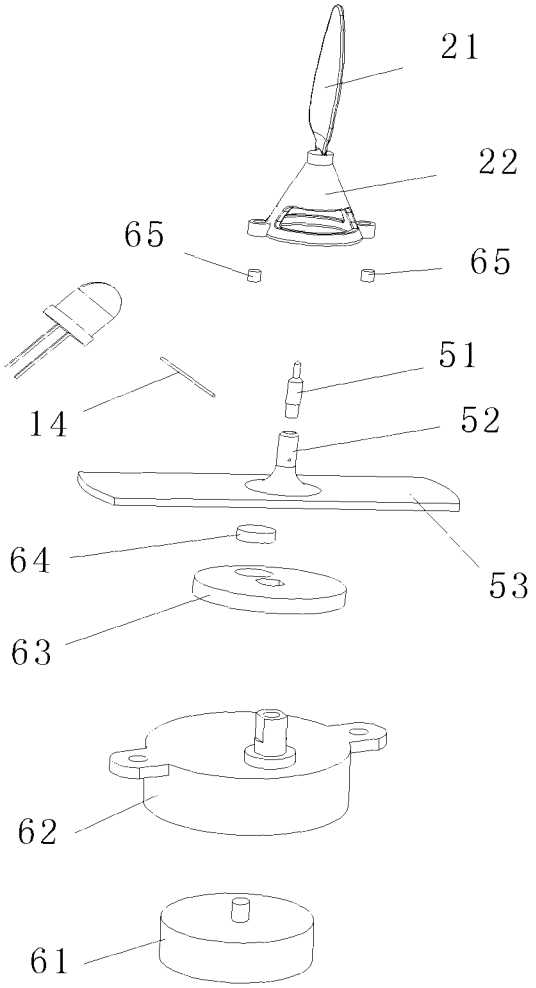
FIG. 6 is an exploded diagram of the partial structure of the fluttering-flame simulation device described in Example 2 of the present invention.

As shown in FIGS. 5 and 6, another fluttering-flame simulation device is provided, comprising a shell 1, a flame body 2, and an external force generating device 6 mounted inside the shell 1, as well as a light emitting device 4. Compared with the flame device of the above Example 1, the flame device of Example 2 is changed in its shake amplitude limit mechanism and external force generating device, respectively.

Figure 7:
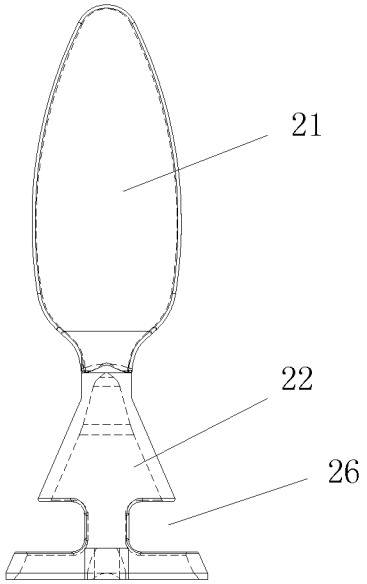
FIG. 7 is a schematic diagram of the structure of the flame body described in Example 2 of the present invention.

As shown in FIGS. 5 and 7, the cone 22 at the lower portion of the flame body 2 is provided outside with at least one limit hole 26 or limit slot, and a limit needle 14 is fixed on the support pillar 52 of the support member 5, with the end of the limit needle 14 located in the limit hole 26 or limit slot so as to limit the amplitude of the flame body 2 shaking around.

The external force generating device 6 comprises a motor 61, a gearbox 62, a turntable 63, a first magnet 64 and a second magnet 65, the motor 61 being connected to the gearbox 62 in transmission, the turntable 63 being fixedly connected to the output shaft of the gearbox 62, the first magnet 64 being mounted on the turntable 63, the second magnet 65 being mounted on the bottom of the cone 22 at the lower portion of the flame body 2. When the motor 61 drives the turntable 63 to rotate through the gearbox 62, the first magnet 64 and the second magnet 65 can make the flame body 2 shake through magnetic attraction or repulsion.

Example 3

Figure 8:
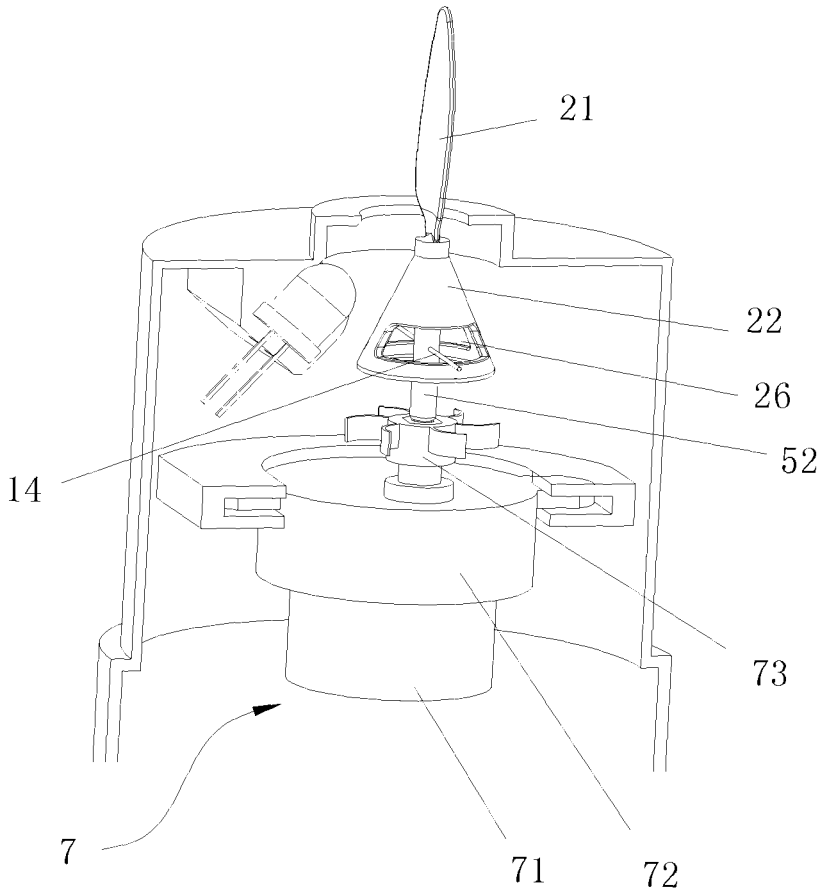
FIG. 8 is a schematic diagram of the partial structure of the fluttering-flame simulation device described in Example 3 of the present invention.
Figure 9:
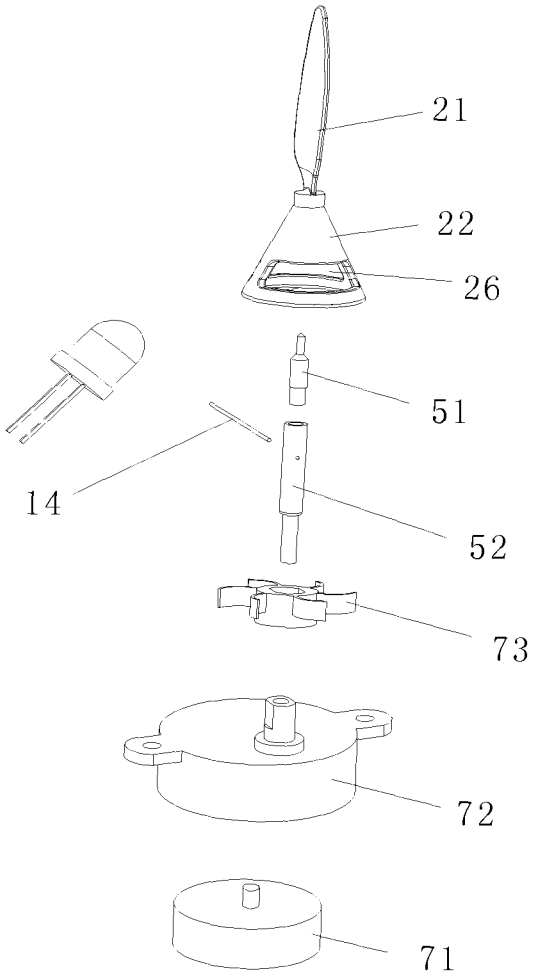
FIG. 9 is an exploded diagram of the partial structure of the fluttering-flame simulation device described in Example 3 of the present invention.

As shown in FIGS. 8 and 9, another fluttering-flame simulation device is provided, comprising a shell 1, a flame body 2, and an external force generating device 7 mounted inside the shell 1, as well as a light emitting device 4. Compared with the flame device of the above Example 2, the flame device of Example 3 is changed in the structure of its support member 5 and external force generating device, respectively.

As shown in FIG. 9, the support member 5 is composed of a support head 51 with balls and a support pillar 52, with the support head 51 fixed at the top of the support pillar 52.

The external force generating device 7 comprises a motor 71, a gearbox 72 and a fan wheel 73, the motor 71 being connected to the gearbox 72 in transmission, the fan wheel 73 being fixedly connected to the output shaft of the gearbox 72, the support pillar 52 of the support member 5 being mounted on the fan wheel 73; when the motor 71 drives the fan wheel 73 to rotate through the gearbox 72, the wind generated by the fan wheel 73 makes the flame body 2 shake.

Example 4

Figure 10:
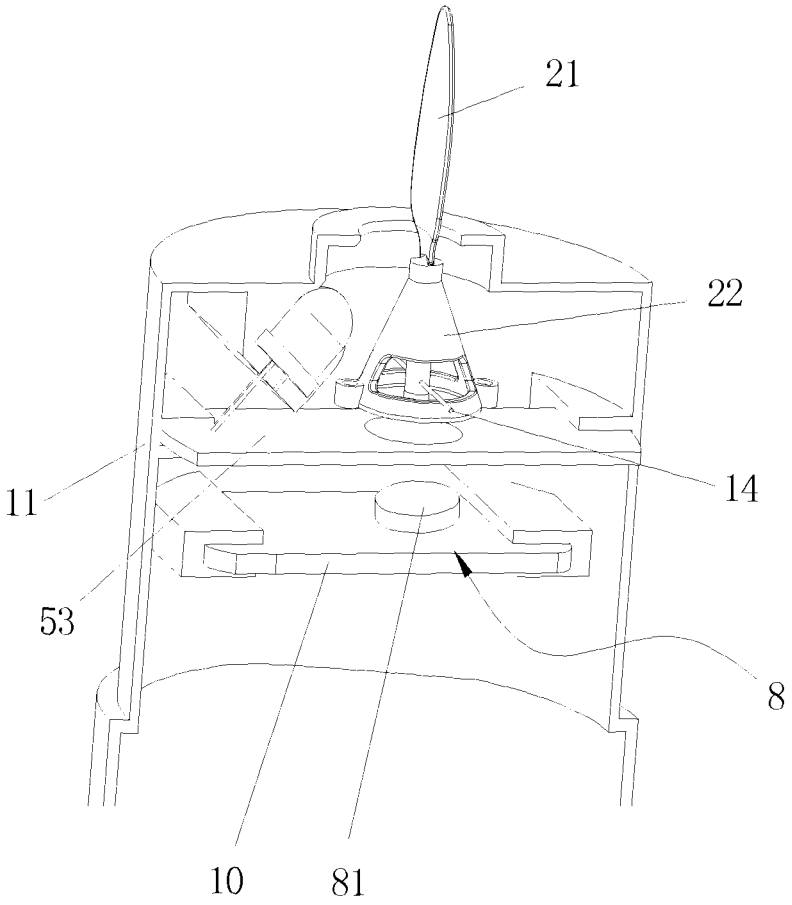
FIG. 10 is a schematic diagram of the partial structure of the fluttering-flame simulation device described in Example 4 of the present invention.
Figure 11:
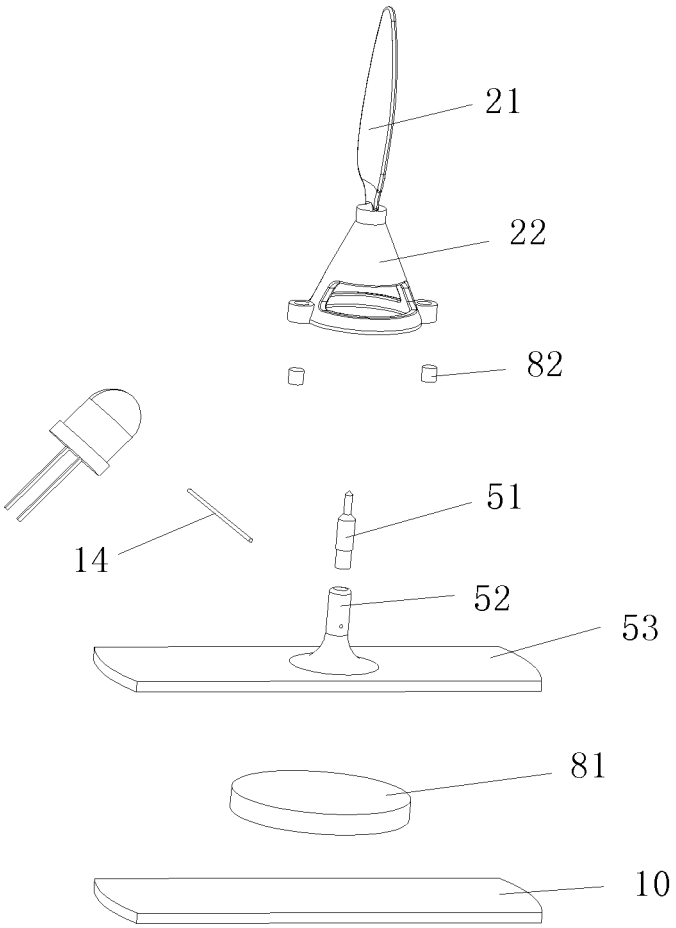
FIG. 11 is an exploded diagram of the partial structure of the fluttering-flame simulation device described in Example 4 of the present invention.

As shown in FIGS. 10 and 11, another fluttering-flame simulation device is provided, comprising a shell 1, a flame body 2, and an external force generating device 8 mounted inside the shell 1, as well as a light emitting device 4. Compared with the flame device of the above Example 2, the flame device of Example 4 is changed in its external force generating device.

Figure 15:
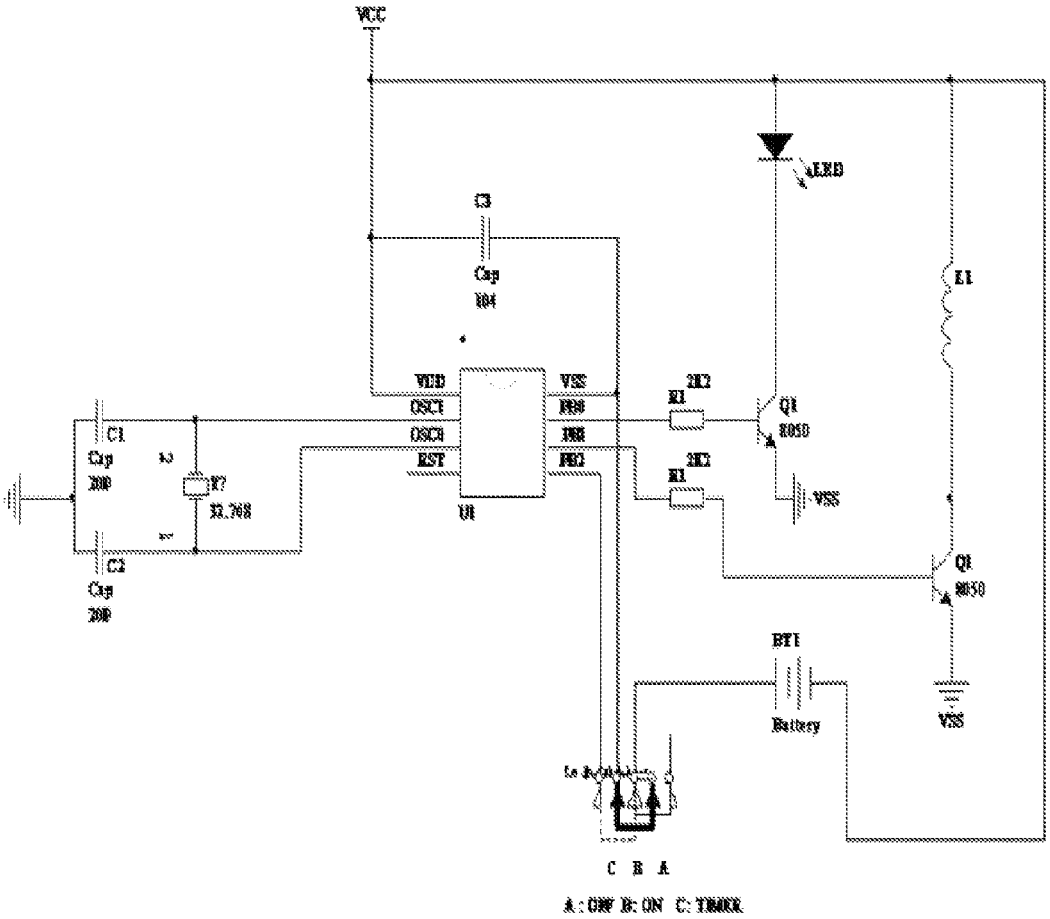
FIG. 15 is a diagram of the electromagnetic-coil-driven circuit on the circuit board of the present invention.

As shown in FIG. 10, the external force generating device 8 comprises an electromagnetic coil 81 and a third magnet 82, with the third magnet mounted on the bottom of the cone 22 at the lower portion of the flame body 2. As shown in FIG. 15, the circuit board 10 is provided with an electromagnetic-coil-driven circuit. While in operation, the electromagnetic coil 81 can generate a magnetic force from time to time that, together with the third magnet 82, makes the flame body 2 shake through the magnetic attraction or repulsion.

Example 5

Figure 12:
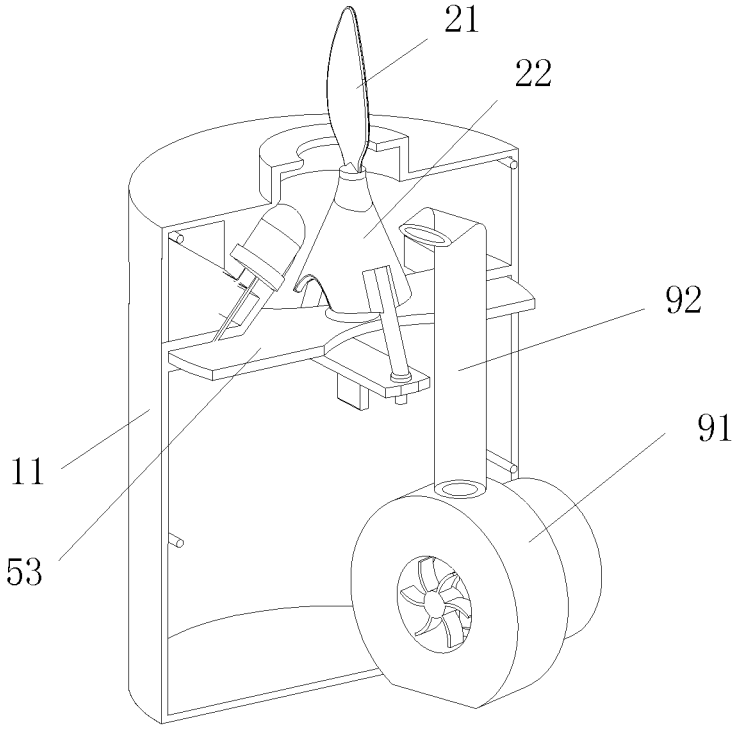
FIG. 12 is a schematic diagram of the partial structure of the fluttering-flame simulation device described in Example 5 of the present invention.
Figure 13:
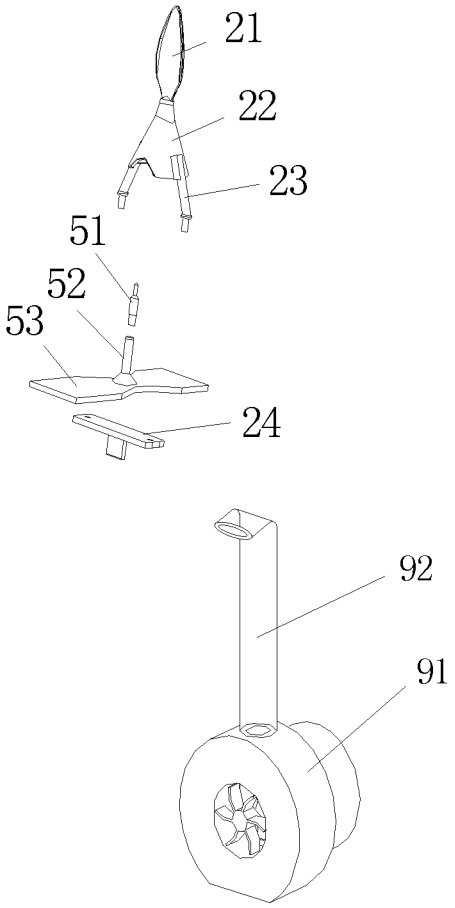
FIG. 13 is an exploded diagram of the partial structure of the fluttering-flame simulation device described in Example 5 of the present invention.

As shown in FIGS. 12 and 13, another fluttering-flame simulation device is provided, comprising a shell 1, a flame body 2, and an external force generating device 9 mounted inside the shell 1, as well as a light emitting device 4. Compared with the flame device of the above Example 1, the flame device of Example 5 is changed in its external force generating device.

As shown in FIG. 12, the external force generating device 9 comprises a water pump 91, which is mounted in a sealed cavity formed in the shell 1. While in operation, the water pump 91 can make the liquid in the sealed cavity impact the flame body 2 through a water pipe 92 to cause the flame body 2 to shake.

In this example, the liquid may be water or a liquid having a pleasant smell, such as essence, which can improve practicability of the product and create a better atmosphere for users.

In summary, the present invention greatly improves fidelity and fluttering sensation of the product, and enhances the visual experience for the product, making the product simulate real fire more realistically and thus more interesting and entertaining.

The examples as described above are the preferred embodiments of the present invention. However, the embodiments of the present invention are not restricted to the above examples. Any other alteration, modification, substitution, combination and simplification, so long as not departing from spirit of the present invention, should be regarded as equivalent replacement, and fall within the scope of protection of the present invention.

What is claimed is:

1. A fluttering-flame simulation device, comprising a shell, a flame body, and an external force generating device mounted inside the shell, as well as at least one light-emitting device, characterized in that: with the flame body provided at an upper portion with a flame sheet imitating a shape of flame and having certain curvature, the flame sheet extends out of the shell through a through hole in the shell, and light of the light-emitting device is projected upon the flame sheet; at a lower portion of the flame body is a hollow cone; the shell is provided inside with a support member, which extends into the cone at the lower portion of the flame body to support the flame body, making the flame body still able to return to an initial vertical state after shaking around a support point under a force from the external force generating device, thus forming a tumbler-type flame body; the support member is composed of a support head and a support pillar, with the support head fixed at the top of the support pillar; the cone at the lower portion of the flame body is provided outside with two symmetrical limit bars, which are connected at the lower end with a mounting plate; the cone at the lower portion of the flame body is spaced from the mounting plate, with a support plate located between the cone at the lower portion of the flame body and the mounting plate; when the flame body shakes, the limit bars are capable of touching the support plate so as to limit an amplitude of the flame body shaking around.

2. The fluttering-flame simulation device according to claim 1, characterized in that: the flame sheet is composed of a photosensitive sheet made of three different photosensitive materials.

3. The fluttering-flame simulation device according to claim 1, characterized in that: the shell comprises an inner shell and a candle-shaped outer shell, with the outer shell sleeved outside the inner shell.

4. The fluttering-flame simulation device according to claim 1, characterized in that: the shell is provided inside with a circuit board and a power supply unit used for controlling the external force generating device and the light-emitting device, with the circuit board electrically connected with the external force generating device, the light-emitting device and the power supply unit.

5. The fluttering-flame simulation device according to claim 1, characterized in that: the external force generating device comprises a water pump, which is mounted in a sealed cavity formed in the shell, with the water pump making the liquid in the sealed cavity impact the flame body through a water pipe to cause the flame body to shake.

6. The fluttering-flame simulation device according to claim 5, characterized in that: the liquid is water or a liquid having a pleasant smell.

7. The fluttering-flame simulation device according to claim 1, characterized in that: the external force generating device comprises a motor, a gearbox and a Y-shaped rotating touch arm, the motor being connected to the gearbox in transmission, the rotating touch arm being fixedly connected to an output shaft of the gearbox, a collision block being provided on the mounting plate on the bottom of the cone at the lower portion of the flame body; when the motor drives the rotating touch arm to rotate through the gearbox, the rotating touch arm can collide with the collision block, thus making the flame body shake.

8. A fluttering-flame simulation device, comprising a shell, a flame body, and an external force generating device mounted inside the shell, as well as at least one light-emitting device, characterized in that: with the flame body provided at an upper portion with a flame sheet imitating a shape of flame and having certain curvature, the flame sheet extends out of the shell through a through hole in the shell, and light of the light-emitting device is projected upon the flame sheet; at a lower portion of the flame body is a hollow cone; the shell is provided inside with a support member, which extends into the cone at the lower portion of the flame body to support the flame body, making the flame body still able to return to an initial vertical state after shaking around a support point under a force from the external force generating device, thus forming a tumbler-type flame body: the support member is composed of a support head, a support pillar, and a support plate mounted in the shell, with the support head fixed at a top of the support pillar that is fixed on the support plate; the cone at the lower portion of the flame body is provided outside with two symmetrical limit bars, which are connected at the lower end with a mounting plate; the cone at the lower portion of the flame body is spaced from the mounting plate, with the support plate located between the cone at the lower portion of the flame body and the mounting plate; when the flame body shakes, the limit bars are capable of touching the support plate so as to limit an amplitude of the flame body shaking around.

9. The fluttering-flame simulation device according to claim 8, characterized in that: the external force generating device comprises a motor, a gearbox and a Y-shaped rotating touch arm, the motor being connected to the gearbox in transmission, the rotating touch arm being fixedly connected to an output shaft of the gearbox, a collision block being provided on the mounting plate on the bottom of the cone at the lower portion of the flame body; when the motor drives the rotating touch arm to rotate through the gearbox, the rotating touch arm can collide with the collision block, thus making the flame body shake.

10. The fluttering-flame simulation device according to claim 8, characterized in that: the flame sheet is composed of a photosensitive sheet made of three different photosensitive materials.

11. The fluttering-flame simulation device according to claim 8, characterized in that: the shell comprises an inner shell and a candle-shaped outer shell, with the outer shell sleeved outside the inner shell.

12. The fluttering-flame simulation device according to claim 8, characterized in that: the shell is provided inside with a circuit board and a power supply unit used for controlling the external force generating device and the light-emitting device, with the circuit board electrically connected with the external force generating device, the light-emitting device and the power supply unit.

13. The fluttering-flame simulation device according to claim 8, characterized in that: the external force generating device comprises a water pump, which is mounted in a sealed cavity formed in the shell, with the water pump making the liquid in the sealed cavity impact the flame body through a water pipe to cause the flame body to shake.

14. The fluttering-flame simulation device according to claim 13, characterized in that: the liquid is water or a liquid having a pleasant smell.

* * * * *